United States Patent [19]

Caughey

[11] 3,992,242

[45] Nov. 16, 1976

[54] SELF-FEEDING PRESS FOR PRODUCING STRIP MATERIAL

[76] Inventor: Robert A. Caughey, Clinton Road, Antrim, N.H. 03102

[22] Filed: Mar. 24, 1975

[21] Appl. No.: 561,648

Related U.S. Application Data

[62] Division of Ser. No. 499,935, Aug. 23, 1974, Pat. No. 3,905,290.

[52] U.S. Cl. ..... 156/289; 156/311; 156/312; 156/500; 156/583

[51] Int. Cl.[2] ..... B31F 5/00

[58] Field of Search ..... 100/144, 215, 222, 224, 100/295; 156/289, 311, 312, 498, 500, 580, 583, 555; 264/109, 112, 113, 120, 213, 171, 280; 425/89, 406, 407, 408, 411, 336, 338

[56] References Cited

UNITED STATES PATENTS 3,577,304 5/1971 Guyer ..... 156/312

3,905,290 9/1975 Caughey ..... 425/338

*Primary Examiner*—David A. Simmons

*Attorney, Agent, or Firm*—Robert T. Gammons

[57] ABSTRACT

A press for compacting and integrating material to form a continuous strip comprising spaced parallel arrays of long narrow bars, a frame supporting the bars in each array for reciprocal movement, a feeder for supplying material to the space between the arrays of bars at one of the press, rams for effecting relative movement of the arrays of bars toward each other to apply compacting pressure, and rams for effecting longitudinal movement of the bars in each array in a predetermined succession in one direction and for retracting all of the bars in consonance in the other direction.

12 Claims, 16 Drawing Figures

SELF-FEEDING PRESS FOR PRODUCING STRIP MATERIAL

This is a division of application Ser. No. 499,935, filed on Aug. 23, 1974, now U.S. Pat. No. 3,905,290, dated Sept. 16, 1975.

BACKGROUND OF THE INVENTION

The object of this invention is to provide a press whereby pressure can be continuously applied to a substrate such as plywood, wood particle molding compound, laminates and the like while the substrate is simultaneously being moved through the press.

The importance of such a press is apparent when consideration is given to the relation of time and temperature in the curing of the adhesive used; for example, in the production of particle board, say ¾ inch thick, a pressing time of 8 to 10 minutes may be required in the hot press in order to allow time for the center of the strip to reach curing temperature, it being necessary for heat to be transferred from the surfaces of the press platens through ⅜ inch of molding compound.

If, however, the molding compound could be quickly brought to press temperature outside the press and then injected into the press in a matter of a few seconds the press time need be only one minute or less since, at the press temperature employed, the resin can be cured in this short period.

However, with conventional presses in which the molding compound is spread on a tray or caul and then injected into the open press, the time involved in preparing the mat on the caul and loafing and unloading the press is so great that the molding compound must be handled at low temperature in order to prevent precure of the resin or binder before pressure can be applied. Thus with an intermittent pressing operation it is imperative to use cold molding compound which, in turn, requires that the molding compound be raised to curing temperature in the press. This accounts for long press cycles and requires large equipment to achieve substantial production rate.

If, however, the pressing operation could be made continuous so that the mat of molding compound could be laid in the throat of the press continuously and then moved immediately into the press such that the elapsed time between laying of the mat and application of full pressure (with simultaneous reduction to final thickness) could be accomplished in say 10 to 15 seconds then it would become possible to rapidly preheat the molding compound close to curing temperature and draw it into the high pressure zone in a matter of seconds after preheating without danger of precuring. The elapsed time between mat formation and completion of this finished strip would then be only the nominal cure time of the resin system which might be say one minute, since the press platens need to deliver very little heat to the curing mass. Thus the platen areas required for a given throughput of material would be reduced by the ratio of press time of conventional versus a continuous system. This reduction can be of the order of one-third to one-sixth depending on strip thickness. In fact, with a continuous system, using a preheated substrate, very substantial thickness may be cured in a very short time.

SUMMARY

A press for compacting and integrating material while moving through the press comprising spaced parallel arrays of long narrow bars, means supporting the bars in each array for reciprocal movement, means for supplying material to the space between the arrays of bars at one end of the press, and means for effecting longitudinal reciprocal movement of the bars in each array in a predetermined succession in one direction for applying compacting pressure to the material and for retraction of all of the bars in consonance in the other direction to advance the compacted material through the press. Spaced parallel platens support the long narrow bars side-by-side for movement longitudinally and these platens are in turn supported for movement toward each other to enable applying pressure to the material between the bars. Antifriction means in the form of antifriction sheets or roller bearings are disposed between the confronting sides of the platens and the bars to reduce the resistance to sliding movement of the bars relative to the platens. There are rams operably connected to one of the platens for effecting movement toward the other to apply compacting pressure, there is a ram connected to each of the bars to enable advancing each bar independently of every other bar and control means for effecting advance of the bars in a predetermined sequence and retracting the entire number of bars in consonance. At the receiving end of the press the bars at the upper side diverge to facilitate entrance of the unpressed material to the space between the bars. To provide for heating or cooling to effect curing the bars contain passages longitudinally thereof to which a heating or cooling medium is supplied. For particulate material which has very low integrity a carrier web such as paper, a screen or cloth is supported in engagement with the confronting faces of the bars in the two arrays with portions at the entrance end of the press moving toward the entrance to the space between the bars for entraining the uncompressed material and drawing it into the press.

The invention will now be described in greater detail with reference to the accompanying drawings wherein.

Figure 3:
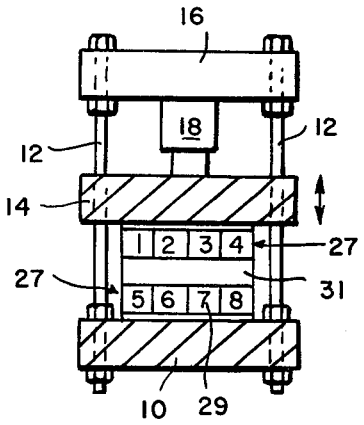
FIG. 3 is an elevation at one end of the press.
Figure 3A:
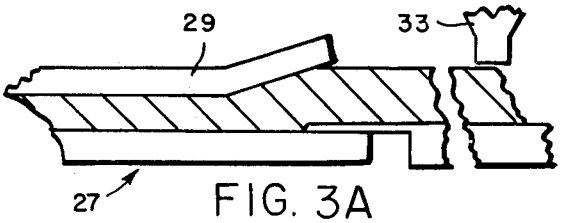
Figure 3B:
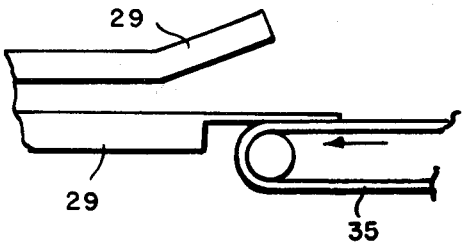
Figures 1, 4:
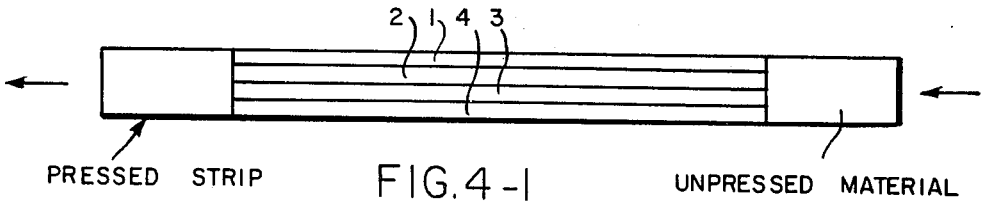
Figures 2, 4:
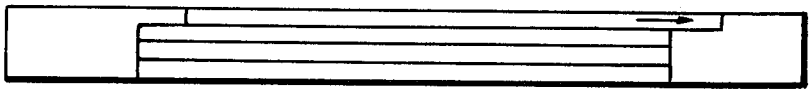
Figures 3, 4:
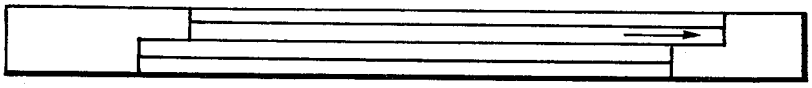
Figure 4:
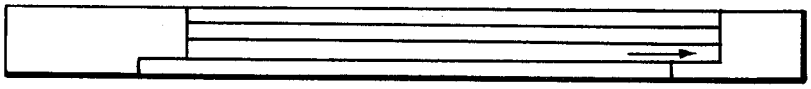
Figures 4, 5:
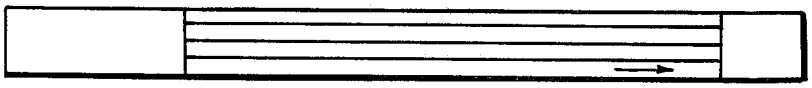
Figure 4:
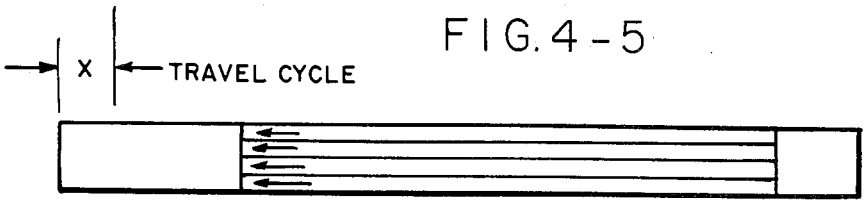
Figure 5:
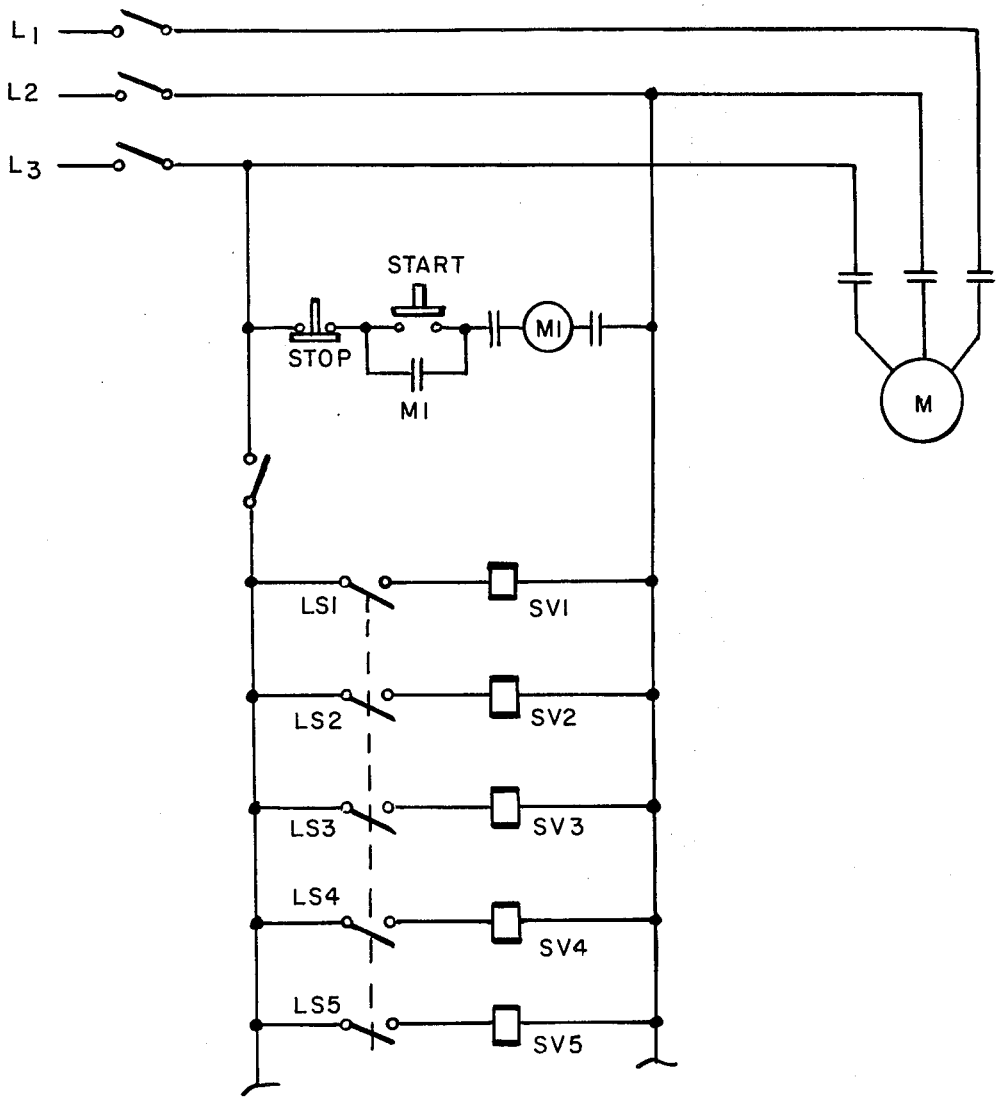
Figure 6:
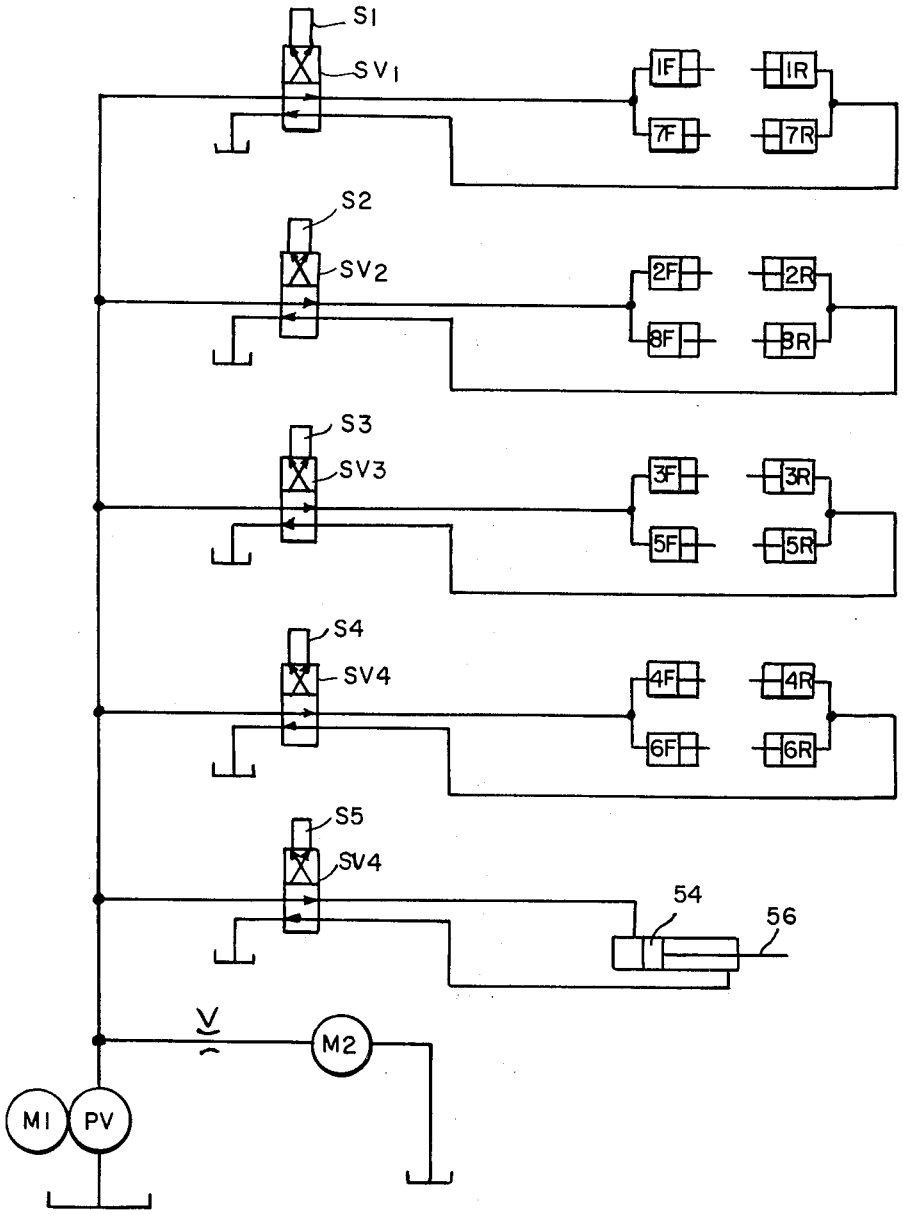
Figure 7:
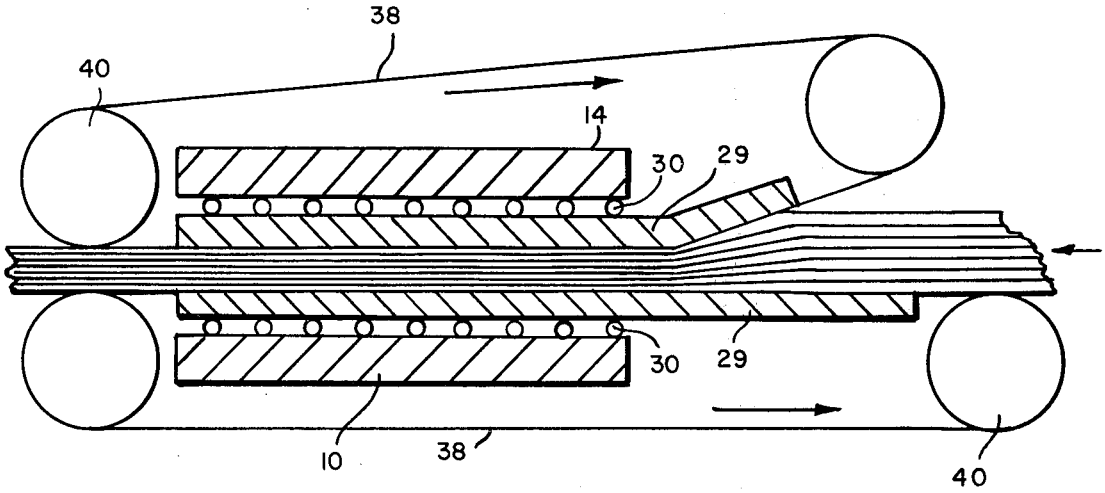
Figure 13:
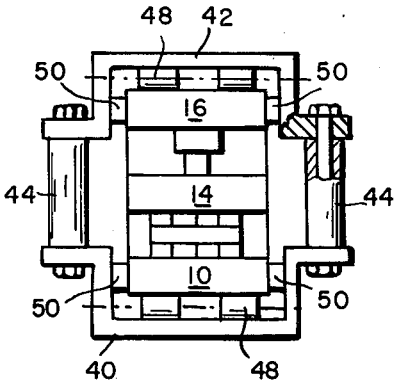
Figure 14:
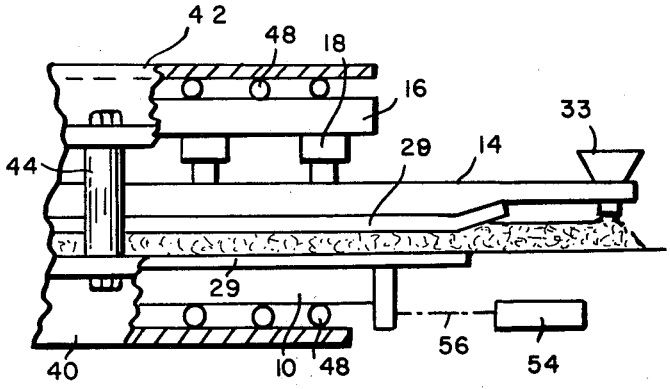
Figure 8:
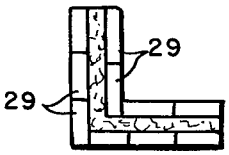
Figure 9:
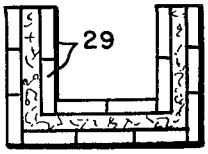
Figure 10:
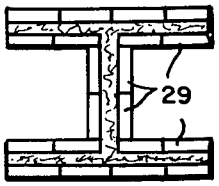
Figure 11:
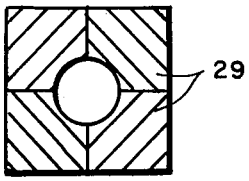
Figure 12:
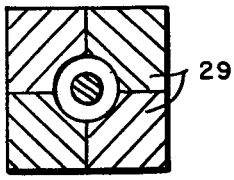

FIG. 3*a* is a fragmentary elevation showing a gravity-type feeder;

FIG. 3*b* is a fragmentary elevation showing a conveyor-type feeder;

FIG. 4 diagrammatically illustrates the sequence of operation of the bars and the travel cycle;

FIG. 5 is a schematic of the electrical control for the press;

FIG. 6 is a schematic of the hydraulic control for the press;

FIG. 7 is a longitudinal section showing the use of conveyor members for inducing particular material into the press;

FIG. 8 diagrammatically illustrates an arrangement of bars for forming an angle section;

FIG. 9 diagrammatically illustrates an arrangement of bars for forming a U-shaped section;

FIG. 10 diagrammatically illustrates an arrangement of bars for forming an eye section;

FIG. 11 diagrammatically illustrates an arrangement of bars for forming a solid rod;

FIG. 12 diagrammatically illustrates an arrangement of bars for forming a hollow cylinder;

FIG. 13 is a transverse section of the press mounted within a frame for longitudinal reciprocal movement; and FIG. 14 diagrammatically shows means for effecting reciprocal movement of the press.

Referring to the drawings (FIGS. 1, 2 and 3), the press comprises a bottom platen 10 along the opposite longitudinal edges of which there are secured at longitudinally spaced intervals posts 12—12 on which there is mounted an upper platen 14 corresponding in configuration and size to the lower platen for movement toward and from the lower platen. Header bars 16 mounted on the upper ends of the posts 12—12 provide for a rigid structure and rams 18 mounted berween the header bars and the platen 14 provide for effecting movement of the upper platen 14 toward and from the lower platen 10.

Figure 1:
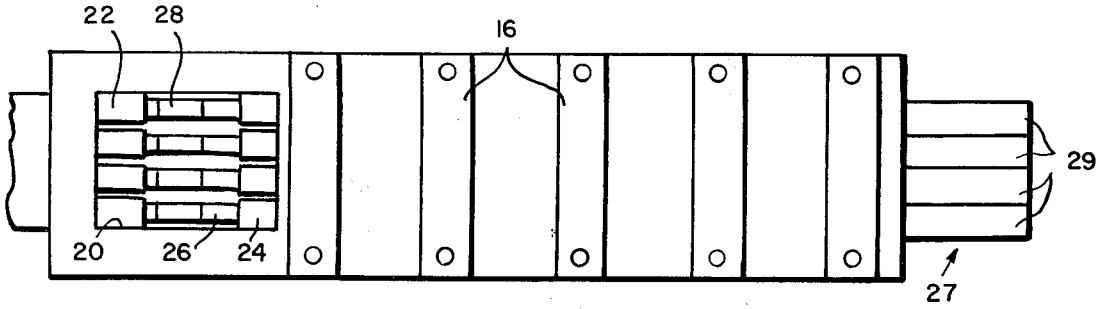
FIG. 1 is a plan view of the press.
Figure 2:
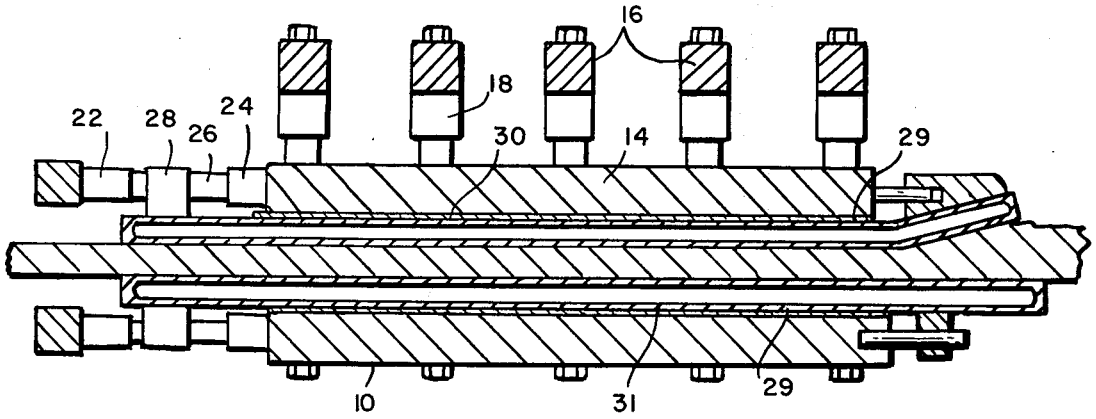
FIG. 2 is a vertical section taken longitudinally of the press.

Each of the platens 10 and 14 has at one end, the left end as shown in FIG. 1, an opening 20 within which there are mounted longitudinally spaced ram cylinders 22, 24 between which there is a common ram 26, the ram cylinders being operable to advance and retract the rams. Two arrays of long narrow bars 27 are mounted between the confronting faces of the platens, there being four bars 29 in each array arranged side-by-side, as shown in FIG. 3, with a space 31 therebetween for receiving material to be compacted and integrated. Each bar 29 has a driving lug 28 mounted to one of the rams 26 by means of which the bars are movable longitudinally and reciprocably with respect to the platens. The bars are slidably supported on the platens, for example, on bars 29 or by dove-tail tongue and groove connections.

To provide for free movement without expenditure of an abnormal amount of power, friction means 30 in the form of strips of antifriction material or roller bearings are disposed between the bars and the platens.

The material which is to be compacted and integrated is introduced to the entrance end of the press (FIG. 2) by means of a suitable dispenser 33 FIG. 3A from which the material gravitates onto the lower one of the platens at the entrance end or by means of a suitable conveyor 35 FIG. 3B for advancing a mat of the uncompressed material to the open end of the press and to facilitate entrance the ends of the upper bars at the entrance end are inclined upwardly relative to the lower bars to provide a converging entrance to the space between the bars. If sheet material such as layers of veneer are to be combined they are pushed along a table provided at the entrance to the press.

The bars 29 may be cored for heating, for example, with steam or cooled, for example with water.

Hydraulic pressure is applied to the rams to effect operation thereof by means of a pump VP (FIG. 6) driven by a motor M1. A hydraulic motor M2 connected to the hydraulic circuit operates to turn a cam shaft which, in turn, operates to close a series of electric switches LS1 to LS4, inclusive, (FIG. 5). The electric switches when closed energize solenoid-operated valves SV1 to SV4, inclusive, which control the rams for moving the bars forwardly and reversely. The cam shaft is designed, as shown in FIG. 6, to supply pressure to rams 1 and 7, then to rams 2 and 8, then to rams 3 and 5 and finally to rams 4 and 6 to move the aforesaid bars forwardly in that sequence and upon reversal of the valves to supply pressure to the rams of all of the bars at the same time to withdraw all of the bars in consonance.

The operating principle of the press depends on a division of the friction between the substrate, that is, the material being compacted and integrated and the moving bars. In the condition shown diagrammatically in FIG. 4 all of the moving bars are in their extreme left position and bearing substantially equal on the substrate. It is reasonable to assume that the coefficient of friction between the substrate and any one of the moving bars will be substantially the same as with any other bar. Thus if sufficient pressure is applied to drive the bar 1 to the right (FIGS. 1 and 2) while the other seven bars are restrained and assuming that the internal shear strength of the substrate is sufficient to resist shearing force due to the friction between the substrate and the surface of the moving bar then the bar will slide over the substrate while the substrate remains in its original position because of the relatively large amount of friction derived from contact with the other seven bars.

If now additional bars 2, 3 and 4, etc. are advanced one at a time (FIGS. 4-2, 4-4, 4-5) to the same forward limit as bar 1 then when all eight bars shall have been advanced to the right, the substrate will still be in its original position but the bars will all have traversed over it to the right by the same increment X of travel. If at this point force is simultaneously applied to all eight bars in the reverse direction they will all move simultaneously to the left with respect to the platens, carrying with them the substrate which will then have been advanced to the left by one increment of bar travel. Repetition of this cycle will thus cause the substrate to move from right to left through the press.

By providing one or both sets of bars at the entrance end of the press with divergent or curved portions so as to form an entrance nip the substrate may be compressed in volume as it enters the space between the bars. The configuration of the entrance is designed to conform to the properties and desired deformation of the substrate. For example, in processing veneers, as in plywood manufacture, the reduction at the entrance to the space between the bars would be slight. However, in the production of particle board where thickness reduction may be 3 or 4 to 1 the divergent relation of the bars to each other at the entrance would have to be substantial.

In the compaction and integration of granular material where the integrity of the mat is very low in the uncompressed condition it is usually necessary to provide a carrier web referred to which may be of paper, screen or cloth to support the material until it shall have been compressed to a degree sufficient to provide an internal shear strength great enough to resist the shear action of the movement of the individual bars. Such a web is shown in FIG. 7 in the form of an endless belt 38 entrained about sheaves 40.

To compensate for variation in density or thickness in the substrate, the press platens may be hydraulically or otherwise loaded to permit some vertical movement while maintaining controlled pressure on the substrate.

The bars as disclosed herein are arranged in spaced parallel arrays in which the bars in each array are situated in a common plane so that the strip produced is flat and has spaced parallel surfaces. It is within the scope of the invention to arrange the bars in the arrays at angles to each other to produce angle members (FIG. 8); channel members (FIG. 9); eye members (FIG. 10); and arcuately or around a common axis to produce solid rods (FIG. 11) and hollow cylinders or sections (FIG. 12).

As thus far described while the strip being formed is continuous the reciprocation of the bars makes delivery of the strip intermittent. To provide for continuous delivery of the strip the press, as indicated in FIG. 13, is reciprocably mounted in a supporting frame comprising a lower frame member 40 and an upper frame member 42 rigidly joined to each other in vertically spaced relation by shouldered tie rods 44, the frame members collectively defining a tunnel within the press is slidingly mounted for reciprocal movement within roller bearings 48 at the top and bottom and roller bearings 50 at the sides. Reciprocal movement of the press can be provided by a cylinder and piston assembly 54 and linkage 56 connecting the piston to the press or a cam-actuated linkage and since the press is reciprocated the source of supply, by means of which the material to be compressed is deposited on the press platen, is provided with a suitable flexible mounting to enable it to follow the reciprocable movement of the press. The reciprocal movement of the press to provide for continuous delivery is synchronized with the movement of the bars so that on the forward movement of the bars the entire press is moved toward the left and on the rearward movement of the bars the entire press is moved toward the right. The stroke of the reciprocal movement of the press would, of course, correspond to the stroke of the bars.

The continuous movement of the strip material enables secondary operations as it is delivered from the press such as laminating, or finishing which is desirably carried out in the same production line.

It should be understood that the present disclosure is for the purpose of illustration only and that this invention includes all modifications and equivalents falling within the scope of the appended claims.

I claim:

1. A method of compacting and integrating material to form a composite structure comprising, delivering the material of which the composite is to be formed onto a support, applying pressure to the material perpendicularly to the exposed surface of the material resting on the support by means of a plurality of narrow elongate bars arranged longitudinally of the support, while holding the bars pressed against the exposed surface of the material, moving them one by one along the exposed surface of the material a predetermined distance without moving the material in that direction until all of the bars have been moved a predetermined distance and then retracting all of the bars simultaneously in the opposite direction said predetermined distance and the material therewith relative to the support to discharge the composite structure from the support.

2. A method according to claim 1 comprising, delivering the material continuously to one end of the support and discharging the composite structure continuously from the opposite end.

3. A method according to claim 1 comprising, continuously delivering the material in a predetermined direction onto the support, moving the bars along the surface one by one in a direction opposite said predetermined direction of delivery of the material of the support and retracting the bars in concert in said predetermined direction for discharge of the composite structure from the support.

4. A method according to claim 1 comprising, reciprocally moving the support and the material resting thereon in directions opposite the movement of the bars during the cycle of movement of the bars.

5. A method according to claim 1, wherein the support is of a predetermined configuration and the bars are arranged adjacent the surface in parallel relation thereto.

6. A method according to claim 1, comprising subjecting the material to heat while under pressure.

7. A method according to claim 1, comprising subjecting the material to cooling while under pressure.

8. The method of compacting and integrating material to form a composite structure comprising, delivering the material of which the composite structure is to be formed to a space of predetermined configuration between spaced arrays of narrow elongated bars, applying pressure through the bars to compact the material between the arrays of bars, while holding the bars pressed against the material, moving less than the entire number of bars at any one time longitudinally in one direction without correspondingly moving the material until all of the bars have been moved said predetermined distance and then retracting all of the bars in consonance and the material therewith in the opposite direction said predetermined distance to discharge the composite structure.

9. The method of compacting and integrating material to form a composite structure comprising, delivering the material of which the composite structure is to be formed to a space of predetermined configuration between arrays of narrow elongated bars, wherein the collective widths of the bars is at least as wide as the transverse width of the structure, applying pressure through the bars to compact the material between the arrays of bars, while holding the bars pressed against the material, moving one or more and less than the entire number of bars at any one time longitudinally in one direction without correspondingly moving the material until all of the bars have been moved said predetermined distance and then retracting all of the bars in consonance and the material therewith in the opposite direction said predetermined distance to discharge a length of the composite structure corresponding to said predetermined distance.

10. A method according to claim 9 comprising, during the cycle of movement of the bars in the one direction and retraction of the bars in the opposite direction reciprocally moving the arrays of bars to effect continuous delivery of the composite structure.

11. A method according to claim 9, comprising subjecting the material to heat during the cycle of movement of the bars.

12. A method according to claim 9, comprising subjecting the material to cooling during the cycle of movement of the bars.

* * * * *